US006891329B2

(12) United States Patent
Nagano et al.

(10) Patent No.: US 6,891,329 B2
(45) **Date of Patent: *May 10, 2005**

(54) EL DEVICE

(75) Inventors: Katsuto Nagano, Tokyo (JP); Takeshi Nomura, Tokyo (JP); Taku Takeishi, Tokyo (JP); Suguru Takayama, Tokyo (JP)

(73) Assignee: The Westaim Corporation, Fort Saskatchewan (CA)

( * ) Notice: Subject to any disclaimer, the term of this patent is extended or adjusted under 35 U.S.C. 154(b) by 134 days.

This patent is subject to a terminal disclaimer.

(21) Appl. No.: 09/731,866

(22) Filed: Dec. 8, 2000

(65) Prior Publication Data

US 2001/0015619 A1 Aug. 23, 2001

Related U.S. Application Data

(63) Continuation of application No. PCT/JP00/02231, filed on Apr. 6, 2000.

(30) Foreign Application Priority Data

Apr. 8, 1999 (JP) ..... 11-101195

(51) Int. Cl.[7] ..... H01J 1/62

(52) U.S. Cl. ..... 313/509; 313/506; 428/690; 428/917

(58) Field of Search ..... 313/503, 506, 313/509; 428/690, 917

(56) References Cited

U.S. PATENT DOCUMENTS

| | | | | | |
|---|---|---|---|---|---|
| 3,560,784 | A | * | 2/1971 | Steele et al. | 313/92 |
| 4,613,546 | A | | 9/1986 | Kuwata et al. | 428/336 |
| 5,055,360 | A | * | 10/1991 | Ogura et al. | 428/473.5 |
| 5,335,139 | A | * | 8/1994 | Nomura et al. | 361/4 |
| 5,403,673 | A | | 4/1995 | Haga et al. | 428/688 |
| 5,496,597 | A | | 3/1996 | Soininen et al. | 427/584 |
| 5,756,147 | A | | 5/1998 | Wu et al. | 427/66 |
| 5,858,561 | A | * | 1/1999 | Epstein et al. | 428/690 |
| 6,008,578 | A | * | 12/1999 | Chen | 313/506 |
| 6,008,981 | A | * | 12/1999 | Harada et al. | 361/321.4 |
| 6,051,516 | A | * | 4/2000 | Mizuno et al. | 501/138 |
| 6,185,087 | B1 | * | 2/2001 | Park et al. | 361/321.4 |
| 6,207,302 | B1 | * | 3/2001 | Sugiura et al. | 428/690 |
| 6,399,222 | B2 | * | 6/2002 | Arai et al. | 428/690 |
| 6,428,914 | B2 | * | 8/2002 | Nagano et al. | 428/917 |
| 6,597,108 | B2 | * | 7/2003 | Yano et al. | 313/503 |

FOREIGN PATENT DOCUMENTS

| | | |
|---|---|---|
| EP | 0 421 494 | 4/1991 |
| EP | 0 615 402 | 9/1994 |
| JP | 62-278791 | 12/1987 |
| JP | 62-278792 | 12/1987 |
| JP | 63-69193 | 3/1988 |
| JP | 64-63297 | 3/1989 |
| JP | 2-44691 | 2/1990 |
| JP | 4-237902 | 8/1992 |
| JP | 6-84692 | 3/1994 |
| JP | 7-50197 | 2/1995 |
| JP | 7-44072 | 5/1995 |
| WO | WO 93/23972 | 11/1993 |

* cited by examiner

*Primary Examiner*—Edward J. Glick
*Assistant Examiner*—Jurie Yun
(74) *Attorney, Agent, or Firm*—Oblon, Spivak, McClelland, Maier & Neustadt, P.C.

(57) ABSTRACT

The EL device of the present invention has a structure in which a first electrode, a first insulator layer, an electroluminescence-producing light emitting layer, a second insulator layer, and a second electrode layer are successively stacked on an electrical insulating substrate. At least one of the first insulator layer and the second insulator layer has as a main component barium titanate and in addition 0.1 to 3 mole % magnesium oxide, 0.05 to 1.0 mole % manganese oxide, no more than 1 mole % yttrium oxide, 2 to 12 mole % of barium oxide and calcium oxide, and 2–12 mole % silicon oxide.

15 Claims, 1 Drawing Sheet

EL DEVICE

CROSS-REFERENCE TO RELATED APPLICATIONS

This application is a continuation and claims priority to International Application No. PCT/JP00/02231 filed Apr. 6, 2000 and Japanese Application No. 11-101195, filed Apr. 8, 1999, and the entire content of both applications is hereby incorporated by reference.

TECHNICAL FIELD

The present invention relates to an EL device preferably used as a thin yet flat form of display means.

BACKGROUND OF ART

An EL device comprising a light emitting layer formed of an inorganic compound and interleaved between upper and lower insulator thin films is excellent in luminance characteristics and stability upon driven on AC current. EL devices fabricated through a fabrication process where all process steps are carried out with thin-film technologies are now used for a variety of displays. One basic arrangement of such a light emitting device is shown in FIG. 2.

This light emitting device has on a glass substrate 21 a multilayered film structure comprising a transparent electrode 22 formed of ITO or the like, a thin-film first insulator layer 23 and a thin-film light emitting layer 24 composed of an electroluminescence-producing fluorescent material such as ZnS:Mn, and further comprising on the light emitting layer 24 a thin-film second insulator layer 25 and a back electrode 26 formed of an Al thin film or the like, and makes use of light emitted out of the transparent glass substrate side.

Each of the thin-film first and second insulator layers is a transparent dielectric thin film made up of $Y_2O_3$, $Ta_2O_5$, $Al_2O_3$, $Si_3N_4$, $BaTiO_3$, $SrTiO_3$, etc., and formed by a sputtering or evaporation process.

These insulator layers perform important functions in limiting currents passing through the light emitting layer to contribute to improvements in the stability of operation and light emission of the thin-film EL device, and protecting the light emitting layer against moisture and harmful ion contamination to improve the reliability of the thin-film EL device.

However, such a device has some practical problems. One problem is that it is difficult to reduce the dielectric breakdown of the device to nil over a wide area, resulting in low yields, and another is that the applied driving voltage necessary for the device to emit light becomes high because voltage is dividedly applied to the insulator layers.

To solve the dielectric breakdown problem, it is preferable to use an insulator material having good dielectric strength properties. To provide a solution to the light emission-driving voltage problem, it is preferable to increase the capacity of the insulator layers, thereby reducing the proportion of the voltage dividedly applied to the insulator layers. In view of the principles of operation of such a thin-film EL device of the AC driving type, the current passing through the light emitting layer contributing to light emission is virtually proportional to the capacity of the insulator layers. To decrease the driving voltage and enhance the luminance of light emission, it is therefore of vital importance to increase the capacity of the insulator layers.

For this reason, it is attempted to use a ferroelectric $PbTiO_3$ film of high dielectric constant formed by a sputtering process as an insulator layer, thereby achieving low-voltage driving. This $PbTiO_3$ sputtered film shows a dielectric strength of 0.5 MV/cm at a relative permittivity of 190 at most. However, the temperature of the substrate must be elevated to about 600° C. for $PbTiO_3$ film formation, and so it is difficult to apply the $PbTiO_3$ film to the fabrication of hitherto thin-film EL devices using a glass substrate. Besides, a $SrTiO_3$ film formed by a sputtering process, too, is known in the art. This $SrTiO_3$ sputtered film has a relative permittivity of 140 and a dielectric breakdown voltage of 1.5 to 2 MV/cm. This film is formed at 400° C. However, the practical use of the film for a thin-film EL device using a glass substrate offers a problem because an ITO transparent electrode is reduced and blackened during film formation by sputtering.

One possible approach to solving this problem is to use for the glass substrate a glass material that has a high softening point and can be treated at high temperature. In this case, however, the substrate costs much, and the upper limit to the treatment temperature is again 600° C. as well.

Another approach is to make insulator layers thinner. However, the ITO film is susceptible to dielectric breakdown at its edge because of the insufficient dielectric strength of such thinner insulator layers. This is an obstacle to development of large-area and large-capacity displays.

Thus, a conventional thin-film EL device must be driven at high voltage, resulting in the need of using a costly driving circuit of high dielectric strength. This unavoidably makes displays costly and large-area displays hardly achievable.

Among EL devices known to solve these problems, there is an EL device wherein a thin-film light emitting layer 34, a thin-film second insulator layer 35 and a transparent second electrode 36 are stacked on a multilayered ceramic structure comprising a ceramic substrate 31, a thick-film first electrode 32 and a first insulator layer 33 of high dielectric constant, as shown in FIG. 3.

In this EL device, a low-temperature sintering Pb perovskite based material is used for the first insulator layer. However, this material must be used with an increased thickness because of its insufficient dielectric strength. For this reason, it is impossible to reduce the emission start voltage down to a sufficiently low level.

SUMMARY OF THE INVENTION

An object of the present invention is to use an insulator layer, the dielectric strength of which is high yet less susceptible to a change with time and the relative permittivity of which is high yet less susceptible to a change with time, thereby providing an EL device that is so low in the emission start voltage and emission driving voltage that stable light emission performance can be obtained.

Such an object is achievable by the invention defined below.

(1) An EL device having a structure in which a first electrode formed according to a predetermined pattern, a first insulator layer, an electroluminescence-producing light emitting layer, a second insulator layer and a second electrode layer are successively stacked on an electrical insulating substrate, wherein:

at least one of said first insulator layer and said second insulator layer contains as a main component barium titanate and as subordinate components magnesium oxide, manganese oxide, yttrium oxide, at least one oxide selected from barium oxide and calcium oxide, and silicon oxide, with ratios of magnesium oxide, manganese oxide, yttrium oxide, barium oxide, calcium oxide and silicon oxide with respect to 100 moles of barium titanate being:

| | |
|---|---|
| MgO: | 0.1 to 3 moles, |
| MnO: | 0.05 to 1.0 mole, |
| $Y_2O_3$: | 1 mole or less, |
| BaO + CaO: | 2 to 12 moles, and |
| $SiO_2$: | 2 to 12 moles, |

as calculated on MgO, MnO, $Y_2O_3$, BaO, CaO, $SiO_2$ and $BaTiO_3$ bases, respectively.

(2) The EL device according to (1) above, wherein said electrical insulating substrate and said first insulator layer are each formed of a ceramic material.

(3) The EL device according to (1) or (2) above, which contains BaO, CaO and $SiO_2$ in a form represented by $(Ba_xCa_{1-x}O)_y.SiO_2$ where $0.3 \leqq x \leqq 0.7$ and $0.95 \leqq y \leqq 1.05$ and in an amount of 1 to 10% by weight with respect to the sum of $BaTiO_3$, MgO, MnO and $Y_2O_3$.

(4) The EL device according to (2) or (3) above, wherein said first electrode is formed of at least one metal selected from Ni, Cu, W and Mo or an alloy composed mainly of at least one metal selected from said metals.

DETAILED EXPLANATION OF THE PREFERRED EMBODIMENTS

Some illustrative embodiments of the present invention will be explained in detail.

Figure 1:
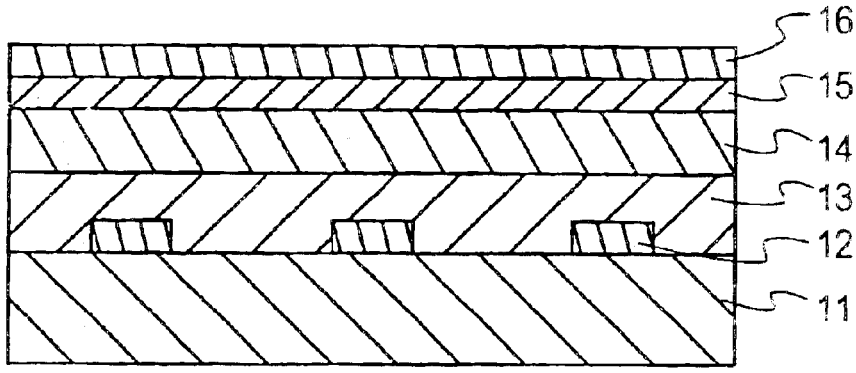
FIG. 1 is a sectional view in schematic from depicting the EL device according to the present invention.
Figure 2:
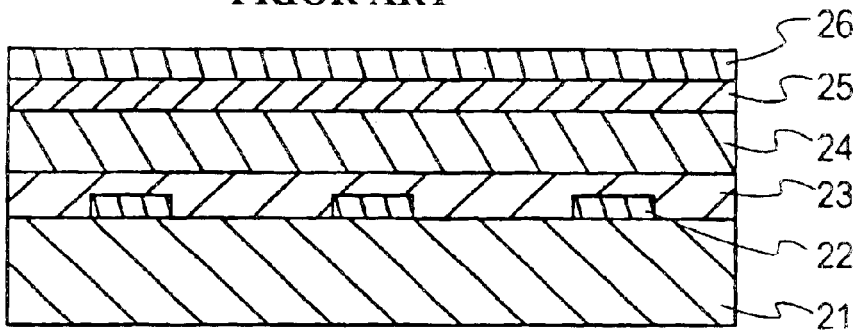
FIG. 2 PRIOR ART
FIG. 2 is a sectional view in schematic form depicting a conventional thin-film EL device.
Figure 3:
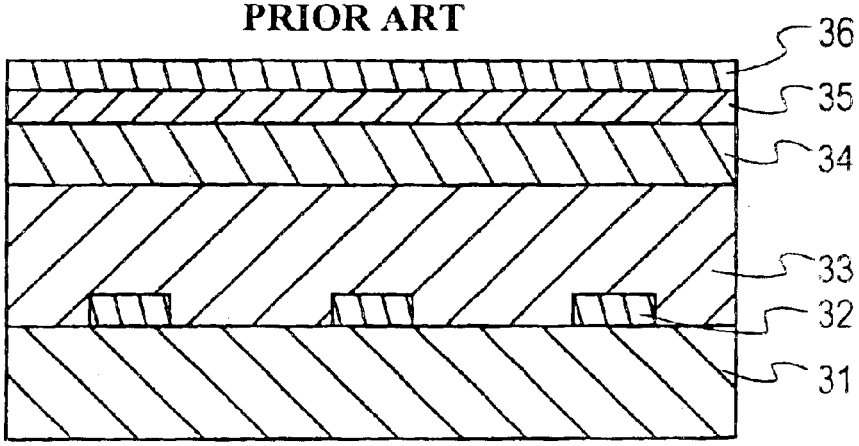
FIG. 3 PRIOR ART
FIG. 3 is a sectional view in schematic form depicting a conventional EL device using a mutilayered ceramic structure.

One basic arrangement of the EL device according to the present invention is shown in FIG. 1. The EL device of the present invention has a structure comprising an electrical insulating substrate 11, a first electrode 12 formed according to a predetermined pattern and a first insulator layer 13, and is provided thereon with a basic structure comprising an electroluminescence-producing light emitting layer 14 formed by a vacuum evaporation process, a sputtering process, a CVD process or the like, a second insulator layer 15 and a second electrode layer 16 formed preferably of a transparent electrode. At least one of the first insulator layer 13 and the second insulator 15 is formed of such a specific composition as detailed below.

The light emitting layer 14 is similar to that used in an ordinary EL device, and the second electrode 16 is an ITO or other film formed using an ordinary thin-film process.

For preferable materials for the light emitting layer, for instance, use may be made of such materials as described in Shosaku Tanaka, "Technical Trends in Recent Displays", Monthly Display, pp. 1–10, April 1998. More specifically, ZnS, Mn/CdSSe, etc. are used as the material to obtain red light emission, ZnS:TbOF, ZnS:Tb, ZnS:Tb, etc. are used as the material to obtain green light emission, and SrS:Ce, $(SrS:Ce/ZnS)_n$, $CaGa_2S_4$:Ce, $Sr_2Ga_2S_4$:Ce, etc. are used for the material to obtain blue light emission.

SrS:Ce/ZnS:Mn, etc. are known for the material to obtain white light emission.

Especially, the most preferable results can be obtained when the present invention is applied to an EL device comprising a blue light emitting layer of SrS:Ce studied in IDW (International Display Workshop), '97 X. Wu., "Multicolor Thin-Film Ceramic Hybrid EL Displays", pp. 593–596.

No particular limitation is imposed on the thickness of the light emitting layer; however, it is understood that too thick a light emitting layer leads to a driving voltage increase whereas too thin a light emitting layer causes an emission efficiency drop. For instance, the light emitting layer has a thickness of the order of preferably 100 to 1,000 nm, and more preferably 150 to 500 nm, although varying depending on the fluorescent material used.

The light emitting layer may be formed by vapor-phase deposition processes represented by physical vapor-phase deposition processes including a sputtering or evaporation process, and chemical vapor-phase deposition processes such as a CVD process, among which the chemical vapor-phase deposition processes such as a CVD process are preferable.

As described in the aforesaid IDW in particular, a light emitting layer of SrS:Ce, when formed by an electron beam evaporation process in a $H_2S$ atmosphere, can have an ever-higher purity.

It is preferable to carry out thermal treatment after the formation of the light emitting layer. The thermal treatment may be carried out after the electrode layer, insulating layer and light emitting layer are stacked on the substrate in this order or cap annealing may be carried out after the electrode layer, insulating layer, light emitting layer and insulating layer optionally with an electrode layer provided thereon are stacked on the substrate in this order. Usually, it is preferable to use a cap annealing process. The heat treatment temperature used herein should be preferably between 600° C. and the substrate sintering temperature, more preferably between 600° C. and 1,300° C., and even more preferably between about 800° C. and about 1,200° C., and the heat treatment time used herein should be between 10 minutes and 600 minutes, and especially between about 30 minutes and about 180 minutes. The annealing atmosphere used herein should preferably be $N_2$, Ar, He, or $N_2$ with up to 0.1% of $O_2$ contained therein.

For the transparent electrode material, it is preferable to use a material of relatively low resistance because of the need of generating an electric field with high efficiency. For instance, it is preferable to use a material composed mainly of any one of tin-doped indium oxide (ITO), zinc-doped indium oxide (IZO), indium oxide ($In_2O_3$), tin oxide ($SnO_2$) and zinc oxide (ZnO). These oxides may deviate slightly from their stoichiometric compositions. The mixing ratio of $SnO_2$ with respect to $In_2O_3$ should be between 1 wt % and 20 wt %, and preferably between 5 wt % and 12 wt %. In IZO, the mixing ratio of ZnO with respect to $In_2O_3$ should usually be of the order of 12 wt % to 32 wt %.

When the ferroelectric material having the specific composition detailed below is used for the first insulator layer, it is preferable that the substrate, first electrode and first insulator layer form together a multilayered ceramic structure. In this case, the first insulator layer and substrate may be made up of the same material or the same material system.

The first insulator layer comprises a barium titanate based ferroelectric material containing as a main component barium titanate and as subordinate components magnesium oxide, manganese oxide, at least one oxide selected from barium oxide and calcium oxide, and silicon oxide. In the insulator layer, the ratios of magnesium oxide, manganese oxide, barium oxide, calcium oxide and silicon oxide with respect to 100 moles of barium titanate are:

| | | |
|---|---|---|
| MgO: | 0.1 to 3 moles, | and preferably 0.5 to 1.5 moles, |
| MnO: | 0.05 to 1.0 mole, | and preferably 0.2 to 0.4 moles, |
| $Y_2O_3$: | 1 mole or less, | |
| BaO + CaO: | 2 to 12 moles, and | |
| $SiO_2$: | 2 to 12 moles, | |

as calculated on MgO, MnO, BaO, CaO, $SiO_2$ and $BaTiO_3$ bases, respectively.

Usually, it is preferable that $(BaO+CaO)/SiO_2$ is in the range of 0.9 to 1.1 although there is no particular limit thereto. BaO, CaO and $SiO_2$ may be contained in the form of $(Ba_xCa_{1-x}O)_y.SiO_2$. To obtain a closely packed sintered body, it is then preferable that $0.3 \leqq x \leqq 0.7$ and $0.95 \leqq y \leqq 1.05$.

The content of $(Ba_xCa_{1-x}O)_y.SiO_2$ should be preferably between 1 wt % and 10 wt %, and more preferably between 4 wt % and 6 wt % with respect to the sum of $BaTiO_3$, MgO and MnO.

It is noted that no particular limitation is imposed on the oxidized state of each oxide; the content of the metal element forming each oxide should be within the above range.

The first insulator layer should preferably contain as an additional subordinate oxide yttrium in an amount of up 1 mole, as calculated on a $Y_2O_3$ basis, with respect to 100 moles of barium titanate as calculated on a $BaTiO_3$ basis. There is no particular lower limit to the content of $Y_2O_3$; however, it is preferable that the content of $Y_2O_3$ should be 0.1 mole or greater to make full use of its effect. When yttrium oxide is used, the content of $(Ba_xCa_{1-x}O)_y.SiO_2$ should be preferably between 1 wt % and 10 wt %, and more preferably between 4 wt % and 6 wt % with respect to the sum of $BaTiO_3$, MgO, MnO and $Y_2O_3$.

It is acceptable that the first insulator layer contains other compound; however, it is preferable that the first insulator layer should be substantially free from cobalt oxide because it gives rise to a large capacity change.

The contents of the subordinate components should be limited to the above ranges for the following reasons.

When the content of magnesium oxide is below the lower limit of the above range, the temperature property of capacity deteriorates. When the content of magnesium oxide exceeds the upper limit of the above range, sinterability drops sharply and so close-packing becomes insufficient, resulting in an increase in the change of dielectric strength with time. This in turn makes it difficult to use the first insulator layer in a thin-film form.

When the content of manganese oxide is below the lower limit of the above range, no satisfactory reduction resistance is obtained. When easily oxidizable Ni is used for the first electrode, it is difficult to use the first insulator layer in a thin-film form due to a large change of dielectric strength with time. When the content of manganese oxide exceeds the upper limit of the above range, the change of capacity with time becomes larger and so the change-with-time of emission luminance of the light emitting device becomes larger.

When the contents of BaO+CaO, $SiO_2$ and $(Ba_xCa_{1-x}O)_y.SiO_2$ are too small, the change of capacity with time becomes large and so the change of emission luminance with time becomes large. Too much causes the dielectric constant to drop sharply, resulting in a rise of the emission start voltage and a luminance drop as well.

Yttrium oxide improves on the durability of dielectric strength. When the content of yttrium oxide exceeds the upper limit of the above range, the capacity decreases, sufficient close-packing is often unachievable due to a sinterability drop.

The first insulator layer may contain aluminum oxide. By the addition of aluminum oxide, it is possible to lower the sintering temperature. The content of aluminum oxide as calculated on an $Al_2O_3$ basis should preferably account for 1 wt % or less of the first insulator layer material. Too much aluminum oxide rather hinders the sintering of the first insulator layer.

No particular limitation is placed on the average crystal grain diameter of the first insulator layer. By allowing the first insulator layer to have the above composition, it can be obtained in a fine crystal form. Usually, the average crystal grain diameter is of the order of 0.2 to 0.7 $\mu$m.

Although the conductive material for the first electrode layer used with the aforsaid multilayered ceramic structure is not critical, yet materials containing one or two or more of Ag, Au, Pd, Pt, Cu, Ni, W, Mo, Fe and Co or any one of Ag—Pd, Ni—Mn, Ni—Cr, Ni—Co and Ni—Al alloys should preferably be used.

When firing is carried out in a reducing atmosphere, base metals may be selected from these materials. Preference is given to one or two or more of Mn, Fe, Co, Ni, Cu, Si, W, Mo, etc. or any one of Ni—Cu, Ni—Mn, Ni—Cr, Ni—Co and Ni—Al alloys, among which Ni and Cu as well as Ni—Cu, alloys, etc. are most preferred.

When firing is carried out in an oxidizing atmosphere, metals that are not converted to oxides in the oxidizing atmosphere should preferably be used. To be more specific, one or two or more of Ag, Au, Pt, Rh, Ru, Ir, and Pd may be used, although Ag and Pd was well as Ag—Pd alloys are particularly preferred.

When the above multilayered ceramic structure is used, no particular limitation is again placed on the material for the substrate. However, it is preferable to use $Al_2O_3$ optionally with $SiO_2$, MgO, CaO, etc. added thereto for various purposes, for example, for sintering temperature control. When such a multilayered ceramic structure is not used, use may be made of a glass substrate employed for an ordinary EL device. However, it is preferable to use a high-melting point glass that can be treated at higher temperatures.

The above multilayered structure may be fabricated by an ordinary fabrication process. More specifically, a binder is mixed with the starting ceramic powders that are to provide a substrate, thereby making a paste. Then, the paste is formed into film by casting to make a green sheet. The first electrode to provide a ceramic internal electrode is printed on the green sheet by a screen printing process or the like.

Then, the assembly is fired, if required, after which a paste prepared by mixing a binder with high dielectric material powders is printed on the assembly by a screen printing process or the like. Finally, firing yields a multilayered ceramic structure.

Firing following binder removal is carried out at 1,200 to 1,400° C., preferably 1,250 to 1,300° C. for several tens of minutes to a few hours.

For firing, the oxygen partial pressure should preferably be between $10^{-8}$ atm. and $10^{-12}$ atm. Since the first insulator layer is placed in a reducing atmosphere under this condition, any one metal selected from inexpensive base metals such as Ni, Cu, W and Mo or an alloy composed mainly of one or more such metals may be used for the electrode. If required in this case, the green sheet and first electrode pattern may be fired while a layer for preventing diffusion of oxygen, e.g., the same layer as the first insulator layer is located between them.

When firing is carried out in the reducing atmosphere, it is preferable to anneal the composite substrate. Annealing is the treatment for re-oxidizing the first insulator layer, so that the change of dielectric strength with time can be reduced.

The partial pressure of oxygen in the annealing atmosphere should preferably be $10^{-6}$ atm. or greater, and especially between $10^{-5}$ atm. and $10^{-4}$ atm. When the oxygen partial pressure is below the lower limit of the above range, it is difficult to re-oxidize the insulator layer or the dielectric layer. At an oxygen partial pressure exceeding the upper limit of the range, the internal conductor tends to oxidize.

The holding temperature for annealing should preferably be 1,100° C. or lower, and especially between 500° C. and 1,000° C. When the holding temperature is below the lower limit of the above range, the oxidization of the insulator layer or the dielectric layer tends to become insufficient, resulting in life reductions. At a holding temperature exceeding the upper limit of the range, the electrode layer tends to oxidize, not only resulting in a capacity drop but also leading to reactions with the insulator material or the dielectric material, which again give rise to life reductions.

It is noted that the annealing step may be built up only of either a heating cycle or a cooling cycle. In this case, the temperature holding time is zero; in other words, the holding temperature is tantamount to the highest temperature. The temperature holding time should preferably be between 0 hour and 20 hours, and especially between 2 hours and 10 hours. For the atmospheric gas, it is preferable to use a wetted $N_2$ gas, etc.

Many other fabrication processes may be applied to the multilayered ceramic structure.

For instance, the following two processes may be used.

(1) One process comprises the steps of providing a film sheet such as a PET film sheet, printing a paste containing a given dielectric material for the first insulator layer all over the surface of the film sheet using a printing process or the like, forming a paste pattern containing an electrically conductive material for the first electrode on the first paste using a screen printing process or the like, forming a green sheet formed of a paste containing alumina and other additives for the substrate on the second paste to prepare a multilayered structure, and sintering the structure from which the film sheet is removed. In this case, a light emitting layer and so on are formed on the surface of the structure that was in contact with the film sheet. This process is characterized in that a very flat surface is obtainable.

(2) Another process comprises the steps of providing a previously fired alumina or other ceramic substrate, forming a paste pattern containing an electrically conductive material for the first electrode on the surface of the substrate, printing a paste containing a given dielectric material for the first insulator layer all over the surface of the first paste using a screen printing process or the like, and sintering the assembly including the substrate.

An EL device emits light at portions defined by the first and second electrodes that intersect at right angles, so that images can be displayed thereon. The electrodes have a combined current supply and pixel display function, and are formed according to any desired pattern if required.

When the substrate, first electrode and first insulator layer are fabricated in the form of a multilayered ceramic structure, the pattern for the first electrode may be easily formed by a screen printing process. For ordinary EL device displays, it is hardly required to form extremely fine electrode patterns; the screen printing process that enables an electrode to be formed over a large area at low costs can be used. When a fine electrode pattern is demanded, photolithography may be used.

As explained above, the ceramic material having a specific composition is used for at least one of the first and second insulator layers that are the important elements that form an AC type EL device according to the present invention. This ceramic material is preferable as the insulator layer in the EL device because of having a relative permittivity of 2,000 or greater and a dielectric strength of 150 MV/m.

For an EL device using a conventional ceramic structure, the first insulator layer must have a thickness of 30 to 40 $\mu$m in order to prevent a breakdown of the first insulator layer. According to the present invention, however, the thickness of the first insulator layer can be reduced down to 10 $\mu$m or less, and especially 2 to 5 $\mu$m, so that the emission driving voltage of the EL device can be lowered. This means that when a device is used with the same emission luminance, that device can be driven at a lower driving voltage. This is very effective for driving circuit design.

The first insulator layer according to the present invention has an increased breakdown voltage and is improved in terms of the change of relative permittivity with time at a constant applied voltage, and so ensures stable light emission over an extended period of time.

The light emitting layer, etc. are formed on the multilayered ceramic structure explained above by a thin-film process such as evaporation or sputtering, thereby obtaining an EL device according to the present invention.

EXAMPLE

A binder was mixed with a mixture of $Al_2O_3$ powders with $SiO_2$, MgO and CaO powdery additives to prepare a paste, which was then cast into a green sheet forming a ceramic substrate of 1 mm in thickness. Using a screen printing process, a Ni paste was formed on this ceramic precursor according to a striped pattern of 0.3 mm in width, 0.5 mm in pitch and 1 $\mu$m in thickness. For the material for the first insulator layer, a paste containing pre-fired powders having the composition shown in Table 1 was prepared, This paste was then printed all over the surface of the green sheet with the electrode pattern formed thereon. The post-firing thickness of the printed paste was 4 $\mu$m.

TABLE 1

| Sample No. | Composition of Dielectric Material MgO (mole) | MnO (mole) | (Ba, Ca)$SiO_2$ (wt %) | $Y_2O_3$ (Mole) | ε s | Breakdown Field (MV/m) | Film Thickness (μm) | Emission Start Voltage (V) |
|---|---|---|---|---|---|---|---|---|
| 1 | 1 | 0.19 | 5 | 0.04 | 2850 | 150 | 4 | 52.8 |
| 2 | 1 | 0.375 | 5 | 0.27 | 2530 | 150 | 4 | 53.0 |
| 3 | 1 | 0.19 | 5 | 0.18 | 2920 | 150 | 4 | 52.7 |
| 4 | 1 | 0.375 | 5 | 0.27 | 2690 | 150 | 4 | 52.9 |
| 5 | 1 | 0.375 | 5 | 0.09 | 3040 | 150 | 4 | 52.7 |
| 6 | 1 | 0.375 | 5 | 0 | 3070 | 150 | 4 | 52.7 |
| 7 (comparison) | 0 | 0 | 5 | 0 | 3380 | 6 | 100 | 88.7* |

The asterisk indicates the value found at a thickness (100 μm) where the insulator layer does not break down at a practical applied voltage (400 V), because the insulator layer had a low breakdown field.

The binder was removed from the green sheet under given conditions. Following this, the green sheet was held at 1,250° C. for a constant time in a mixed gas atmosphere composed of wetted $N_2$ and $H_2$ (having an oxygen partial pressure of $10^{-9}$ atm.) for firing, and then subjected to the above oxidization, thereby preparing a multilayered ceramic structure.

Then, ZnS:Mn was vacuum evaporated on the ceramic structure to a thickness of 0.3 μm by co-evaporation of ZnS and Mn. For property improvements, the ceramic structure was annealed in Ar at 650 to 750° C. for 2 hours. Afterwards, a 0.3 μm thick $TaAlO_4$ insulator layer was formed by a sputtering process using a target consisting of a mixture of $Ta_2O_5$ and $Al_2O_3$ to form the second insulator layer. Then, a 0.4 μm thick ITO film was formed by a sputtering process. Subsequently, the ITO film was etched at 0.3 mm width and 0.5 mm pitch while it was arranged at right angles with the aforesaid Ni thick-film, striped electrode, thereby preparing a transparent striped electrode.

The emission start voltage of the obtained EL device samples and the relative permittivity and breakdown voltage of the separately prepared first insulator layer samples are shown in Table 1. The properties of one comparative sample obtained using a $BaTiO_3$ thick film with no additives (MnO, etc.) added thereto are also indicated. In this case, the first insulator layer was formed with a thickness of 100 μm because its breakdown voltage was low.

When the $BaTiO_3$ based ferroelectric film having such a specific composition as used herein is used for the first or second insulator layer in a conventional thin-film type EL device, use may be made of co-evaporation using molecular beam epitaxy, ion-assisted ion beam sputtering or the like. In this case, too, the same effects as those of an EL device using the aforesaid multilayered ceramic structure are obtained by use of a heat-resistant substrate.

EFFECT OF THE INVENTION

According to the present invention as explained above, the $BaTiO_3$ based dielectric material having a specific composition is used for the first insulator layer in the multilayered ceramic structure comprising the substrate, first electrode layer and first insulator layer, so that an EL device can be obtained, which can be driven at a low driving voltage, and is less susceptible to a dielectric breakdown even when high voltage is applied thereon, thereby ensuring stable light emission performance over an extended period of time.

The composite substrate, because of having been fired at high temperature, allows the light emitting layer to be thermally treated at a high temperature lower than the firing temperature, so that light emission performance is stabilized with enhanced luminance.

What we claim is:

1. An EL device comprising a first electrode, a first insulator layer, a thin film inorganic light emitting layer, a second insulator layer and a second electrode layer successively stacked on an electrical insulating substrate, wherein:

at least one of said first insulator layer and said second insulator layer comprises barium titanate, magnesium oxide, manganese oxide, at least one oxide selected from barium oxide and calcium oxide, silicon oxide, and optionally yttrium oxide, wherein the amount of magnesium oxide, manganese oxide, yttrium oxide, barium oxide, calcium oxide and silicon oxide with respect to 100 moles of barium titanate is:

| | |
|---|---|
| MgO: | 0.1 to 3 moles, |
| MnO: | 0.05 to 1.0 mole, |
| $Y_2O_3$: | 1 mole or less, |
| BaO + CaO: | 2 to 12 moles, and |
| $SiO_2$: | 2 to 12 moles. |

2. The EL device according to claim 1, wherein said electrical insulating substrate and said first insulator layer are each formed of a ceramic material.

3. The EL device according to claim 1 or 2, wherein BaO, GaO and $SiO_2$ are present in at least one of the first and second insulator layers in the form of $(Ba_xCa_{1-x}O)_y.SiO_2$ where $0.3 \leqq x \leqq 0.7$ and $0.95 \leqq y \leqq 1.05$ and in an amount of 1 to 10% by weight with respect to the sum of the weights of $BaTiO_3$, MgO, MnO and $Y_2O_3$.

4. The EL device according to claim 2, wherein said first electrode comprises one or two or more of Ni, Ag, Au, Pd, Pt, Cu, W, Fe, and Co or any one of Ag—Pd, Ni—Mn, Ni—Cr, Ni—Co and Ni—Al alloys.

5. The EL device according to claim 3, wherein said first electrode comprises one or two or more of Ni, Ag, Au, Pd, Pt, Cu, W, Fe, and Co or any one of Ag—Pd, Ni—Mn, Ni—Cr, Ni—Co and Ni—Al alloys.

6. The EL device of claim 1, wherein the light emitting layer comprises at least one material selected from the group consisting of ZuS, Mn/CdSSe, ZnS:TbOF, ZnS:Tb, SrS:Ce, $(SrS:Ce/ZnS)_n$, $CaGa_2S_4$:Ce, and SrS:Ce/ZnS:Mn.

7. The EL device of claim 1, wherein the light emitting layer has a thickness of 100 to 1000 nm.

8. The EL device of claim 1, wherein the second electrode comprises at least one material selected from the group consisting of tin-doped indium oxide, zinc-doped indium oxide, indium oxide, tin oxide, and zinc oxide.

9. The EL device of claim 1, wherein the amount of MgO relative to 100 moles of barium titanate is 0.5 to 1.5 moles.

10. The EL device of claim 1, wherein the amount of MnO relative to 100 moles of barium titanate is 0.2 to 0.4 moles.

11. The EL device of claim 1, wherein the ratio (BaO+CaO)/$SiO_2$ is in the range of 0.9 to 1.1.

12. The EL device of claim 1, wherein the amount of yttrium oxide is in the range of 0.1 to 1 moles relative to 100 moles of barium titanate.

13. The EL device of claim 1, wherein the first insulator layer has an average crystal grain diameter of 0.2 to 0.7 $\mu$m.

14. The EL device of claim 1, wherein the first electrode comprises a material selected from the group consisting of Ag, Pd, and Ag—Pd alloys.

15. The EL device of claim 1, wherein the substrate comprises $Al_2O_3$ and optionally one or more oxides selected from the group consisting of $SiO_2$, MgO, and CaO.

* * * * *